US007837526B1

(12) United States Patent
Doffay

(10) Patent No.: US 7,837,526 B1
(45) Date of Patent: Nov. 23, 2010

(54) FLOATABLE WORKSTATION

(76) Inventor: Gerard Doffay, 2730 SW. 19th St., Fort Lauderdale, FL (US) 33312

( * ) Notice: Subject to any disclaimer, the term of this patent is extended or adjusted under 35 U.S.C. 154(b) by 0 days.

(21) Appl. No.: 12/104,824

(22) Filed: Apr. 17, 2008

Related U.S. Application Data

(63) Continuation-in-part of application No. 12/050,725, filed on Mar. 18, 2008.

(60) Provisional application No. 60/951,491, filed on Jul. 24, 2007.

(51) Int. Cl.
*B63B 35/58* (2006.01)

(52) U.S. Cl. ..... 441/40; 52/592.1; 114/345

(58) Field of Classification Search ..... 441/35, 441/40, 45, 65, 129, 130; 114/345, 354, 114/219; 52/302.1, 302.3, 302.4, 592.1, 52/592.4, 748.1
See application file for complete search history.

(56) References Cited

U.S. PATENT DOCUMENTS

| | | | | |
|---|---|---|---|---|
| 3,587,503 | A | 6/1971 | Stehr | |
| 3,595,192 | A | 7/1971 | Vega | |
| 3,626,447 | A | 12/1971 | Hindlin | |
| 4,082,049 | A | 4/1978 | Nicol | |
| 4,227,478 | A | 10/1980 | Preus | |
| 4,569,410 | A | 2/1986 | Michels et al. | |
| 4,602,587 | A | 7/1986 | Lyons | |
| 4,915,047 | A | 4/1990 | Lord et al. | |
| 5,215,031 | A * | 6/1993 | Inman et al. | 114/219 |
| 5,273,473 | A | 12/1993 | Allen | |
| 5,404,825 | A | 4/1995 | McElwain | |
| 5,460,113 | A * | 10/1995 | Gunter | 441/129 |
| 5,544,612 | A | 8/1996 | Eymard | |
| 6,125,780 | A | 10/2000 | Sweetman et al. | |
| 6,409,431 | B1 | 6/2002 | Lynch | |
| 6,435,346 | B1 | 8/2002 | Allain et al. | |
| 6,460,583 | B1 * | 10/2002 | Lindal | 144/347 |
| 6,475,048 | B2 * | 11/2002 | Gredy | 441/129 |
| 6,582,264 | B2 | 6/2003 | Brown | |
| 7,357,688 | B2 * | 4/2008 | Ferrara | 441/35 |
| 2006/0003646 | A1 | 1/2006 | Hendrickson | |

* cited by examiner

*Primary Examiner*—Lars A Olson
(74) *Attorney, Agent, or Firm*—Gold & Rizvi, P.A.; H. John Rizvi; Glenn E. Gold

(57) ABSTRACT

A floatable workstation including an inflatable tube including optional partitions disposed internally within an air receiving cavity of the tube to form one or more inflatable chambers, each chamber including a valve for inflating the chambers. A plurality of corner fasteners is disposed on the corners of the inflatable tube or on a deck assembly. The deck assembly includes a plurality of deckboards assembled together to form a floorboard. The deckboards are assembled via an interlocking assembly feature. The deckboards are secured via a series of straps and D-rings. At least one deckboard may include a receptacle for holding tools or a bucket. A tether arrangement is attached to the floatable workstation for securely positioning the floatable workstation alongside a vessel allowing one or more persons to stand on the workstation to perform maintenance on the outer surfaces of a vessel. The tether arrangement includes tethers, a means for fastening the tethers to the handles, and suction mechanisms.

22 Claims, 17 Drawing Sheets

FLOATABLE WORKSTATION

CROSS-REFERENCE TO RELATED APPLICATION

This application is a Continuation-In-Part, claiming the benefit of co-pending United States Non-Provisional patent application Ser. No. 12/050,725, filed on Mar. 18, 2008 which claims priority to U.S. Provisional Patent Application Ser. No. 60/951,491, filed on Jul. 24, 2007, both of which are incorporated herein in their entirety.

FIELD OF INVENTION

The present invention relates to floating structures, and more particularly to an inflatable workstation including a tether arrangement for positioning the inflatable workstation alongside a vessel thereby allowing one or more persons to stand on the workstation while working on the outer surface of the vessel.

BACKGROUND OF THE INVENTION

Floating structures generally include floating docks, decks, platforms, or the like. Many floating structures are either inflatable, or are constructed from durable buoyant materials both of which are designed to support the weight of one or more individuals and to remain afloat. Such floating structures come in a variety of shapes, and sizes, and are generally used in recreational activities such as swimming or boating. Some floating structures comprise floating rafts or platforms that provide a base structure for swimmers to utilize. Still other floating structures comprise floating docks or decks that are fixedly positioned in one location on the surface of the water, and are used for walking upon, or for securely attaching a boat or vessel in place.

Boaters alike often wash, buff, wax or make necessary repairs to the outer surface of their boat or vessel to maintain both the function and appearance of the vessel. On most occasions, maintenance is conducted on the vessel while the vessel is moored alongside a floating dock. Because the floating dock is fixed in one location, typically only one side of the vessel faces the dock at any one time. This can be frustrating to the boater because either the vessel must be moored on opposite sides of the floating dock, or a floating dock system must be constructed to completely surround the vessel, to permit the boater to gain access to all outer surfaces of the vessel. Alternatively, some boats include pivotable platforms that are pivotally attached to the vessel. The pivotally fixed platform is not a floating platform but rather a platform that is unfolded about a hinge member to form a horizontal platform for a person to stand or sit on.

Although some prior art floating structures are suitably designed for certain applications, many floating structures prevent or frustrate the ability of a boater or gain access to all outer surfaces of a vessel. For example, many floating platforms are fixed in one position, and are not readily adjustable vertically. Other floating structures are structurally designed for long-term, permanent use, and for the most part are permanently placed in a fixed location. Such floating structures are typically anchored, include rigid support legs, or are weighted down preventing such structures from being easily transported. In addition, many floating platforms are bulky, expensive and time consuming to manufacture and assemble, and are typically installed in one location and position for permanent use. The utility of a floating structure is improved if the floating structure can be readily moved or transported to any location, is easy to assemble, and can be secured anywhere alongside a vessel, when needed.

Accordingly, there remains in the art a need for a floating workstation that is adjustably positioned alongside a vessel for allowing boaters to gain access to the outer surfaces of the vessel. There also remains in the art a need for a floatable workstation that includes a tether arrangement that is adapted to control a floatable workstation in a longitudinal and transverse direction in relation to a vessel V, is inexpensive, easy to assemble and use, and can be conveniently stowed and readily transported if needed.

SUMMARY OF THE INVENTION

The present invention overcomes the deficiencies of the known art and the problems that remain unsolved by providing a floatable workstation including an inflatable tube having a floor, and cleats disposed at each corner of the tube. The inflatable tube further includes internal partitions that form at least a first inflatable chamber, and a second inflatable chamber and preferably there are three to five inflatable chambers although any number of chambers may be implemented without departing from the present invention. A plurality of segments is interlocked together to form a floorboard that is secured to the inflatable tube. The floorboard provides a rigid deck for one or more persons to stand or sit on. A tether system includes tethers that are attached to the inflatable tube, and to suction mechanisms. The suction mechanisms are attached to the surface of a vessel for positioning the floatable workstation alongside a vessel allowing one or more persons to conduct maintenance on the outer surfaces of the vessel.

In accordance with one embodiment of the present invention, there is provided a floatable workstation comprising an inflatable tube including a floor, partitions disposed within an air receiving cavity of the tube forming a first inflatable chamber and a second inflatable chamber. A first valve is in fluid communication with the first inflatable chamber, and a second valve is in fluid communication with the second inflatable chamber. A plurality of cleats is disposed on the outer surface of the inflatable tube. A deck assembly is removeably attached to the inflatable tube, and a tether arrangement is releasably attached to the inflatable tube for securely positioning the floatable workstation alongside a vessel.

Advantageously, the floatable workstation further includes a bumper disposed completely around the outer perimeter of the inflatable tube. The bumper acts to protect the vessel and the floatable workstation should the floatable workstation come into contact with the side of the vessel. The floor includes a plurality of drainage holes for allowing water to drain through said holes.

Preferably, the plurality of cleats includes a first cleat, a second cleat, a third cleat and a fourth cleat, each cleat being disposed approximate the four corners of the inflatable tube.

The deck assembly comprises one or more segments. Each segment is detachably assembled together by an interlocking means to form a floorboard. The floorboard is either fixedly attached within a floor recess of the inflatable tube such that the floorboard is secured in place when the inflatable chambers are fully inflated, or alternatively, the floorboard is fixedly attached to the inflatable tube by a means for fastening. The floorboard is completely disposed over the floor of the inflatable tube. The floorboard sections can be assembled via an interlocking tongue and tail arrangement, such as a sliding dovetail design.

The tether arrangement includes four tethers; one end of each tether includes a means for correspondingly fastening the one end of each tether to the first cleat, the second cleat, the third cleat, and the fourth cleat, respectively. A second end of two tethers is attached to a first suction mechanism, and a second end of two other tethers is attached to a second suction mechanism.

Advantageously, each suction mechanism includes one or more suction cups. The means for fastening includes any one of clamps, spring clips, clips, quick release buckles, snaps, rings, snap rings, spring hooks, carabineers, hook and loop fasteners, couplings, clasps, spring biased clasps, S-hooks, spring detents, swivel fasteners, or magnets. Each tether comprises any one of webbing straps, rope, cords, elastic tubes, straps, braids, wires, chains, bungee cords, nylon straps, rubber strips or strands, strings, belts, bands or the like.

Regarding the embodiments described herein, as well as those covered by the claims, the floatable workstation may comprise any shape, size or dimension and the inflatable tube may comprise any one of hyperlon, PVC, a plastic, synthetic, fabric, vinyl, rubber, foam rubber, fabric, mesh, or nylon material coated or laminated with a polymer, polymeric, or polyurethane material, or any combination thereof.

In an alternative embodiment of the present invention, there is provided an inflatable platform comprising an inflatable pontoon including a base, a first air receiving chamber, and a second air receiving chamber or more. Each chamber is separated by two partitions that are disposed within the inflatable pontoon. A first valve is in fluid communication with the first air receiving chamber, and a second valve is in fluid communication with the second air receiving chamber. Grippers are disposed at approximate corners of the inflatable pontoon, and a deckboard assembly is removeably attached to the inflatable pontoon. Advantageously, the deckboard assembly includes non-skid or non-slip features.

The inflatable platform further includes a tether system including a plurality of tethers that are attached to the grippers, and to suction mechanisms for securely positioning the inflatable platform alongside a vessel.

In an alternative embodiment of the present invention, there is provided an inflatable workstation system comprising, an inflatable workstation comprising an inflatable tube including a base module, a first air receiving chamber, and a second air receiving chamber wherein the chambers are separated by internal partitions disposed within the inflatable tube. A first valve in fluid communication with the first air receiving chamber, and a second valve in fluid communication with the second air receiving chamber. A plurality of cleats is disposed at approximate corners of the inflatable tube, and a deckboard assembly is removeably attached to the inflatable tube. The system further includes a tether system comprising a plurality of tethers, a first tether and a second tether of the plurality of tethers correspondingly attached to a first cleat and a second cleat of the plurality of cleats, and to a first suction mechanism. A third tether and a fourth tether of the plurality of tethers are correspondingly attached to a third cleat and a fourth cleat of the plurality of cleats, and to a second suction mechanism.

The present invention further includes an inter workstation coupling member. The inter workstation coupling member secures two or more adjacent workstations. A first embodiment utilizes an interlinking deckboard that is engaged with a first end of the floorboard of a first workstation and a first end of the floorboard of a second workstation. The interlinking deckboard can be oriented either laterally or longitudinally. An alternate embodiment utilizes tethers for interlinking two adjacent workstations by tethering between respective d-rings of the workstations.

The first suction mechanism and the second suction mechanism include one or more suction cups. The suction cups are releasably attached to the surface of the vessel for positioning the inflatable workstation alongside the vessel.

DETAILED DESCRIPTION OF THE PREFERRED EMBODIMENTS

One or more embodiments of the present invention are disclosed herein. It will be understood that the claims and embodiments of the present invention are intended to be coextensive with each other, and that the embodiments are merely exemplary of the invention that may be embodied in various and alternative forms. It is noted that, according to common practice, the various features, elements and dimensions of particular embodiments are not to scale, and may be expanded, exaggerated or minimized for clarity. Thus, specific structural and functional details, dimensions, shapes, or configurations disclosed herein are not limiting but serve as a basis for teaching a person of ordinary skill in the art the described and claimed features of embodiments of the present invention.

The term "vessel" as used in this context will be construed to include any one of a boat, ship, submarine, cruise liner, watercraft, yacht, offshore installations, marine installations, an amphibious platform or apparatus, a submergible tank or container, or any other aquatic device or installation in which a floatable workstation may be positioned alongside for allowing persons to conduct maintenance on the outer surfaces of such vessels.

Figure 1:
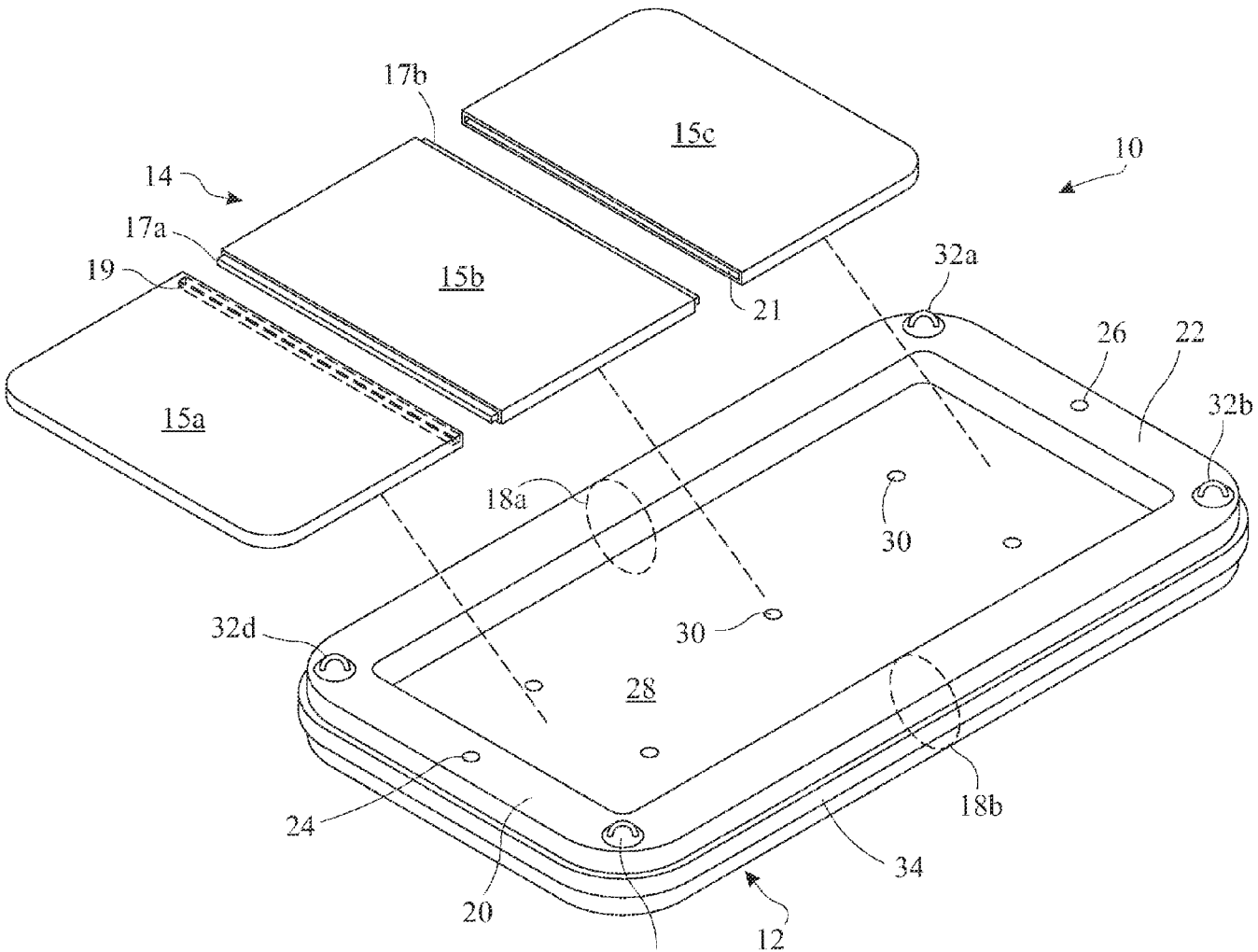
FIG. 1 shows an exploded perspective view of a floatable workstation, according to one embodiment of the present invention.

Referring now to the drawings wherein like reference characters designate like or corresponding parts throughout the several views, there is shown in FIG. 1, an exploded perspective view of a floatable workstation 10, according to one embodiment of the present invention. The floatable workstation 10 comprises an inflatable shell or pontoon 12, a deck assembly 14 forming a floorboard, and a tether arrangement 16, 16*a*, as better illustrated in FIG. 3.

The inflatable pontoon or tube 12 constitutes a substantially rectangular shape, however, the pontoon 12 may comprise a variety of different shapes and sizes, including square, round, or elliptical. The inflatable pontoon 12 may be fabricated from any one of hyperlon, PVC, a plastic, synthetic, fabric, vinyl, rubber, foam rubber, fabric, mesh, or nylon material coated or laminated with a polymer, polymeric, or polyurethane material, or any combination thereof. It will be noted that the inflatable pontoon 12 may include internal beams, supports, ribs or reinforcement materials that are structurally integrated within or about the pontoon 12 to provide structural strength, stability and rigidity.

The inflatable tube 12 further includes two or more internal partitions 18*a*, and 18*b*. The internal partitions 18*a*, 18*b* are disposed internally within the air receiving cavity of tube 12. Each partition 18*a*, 18*b* is configured to block a cross-sectional area of the internal air receiving cavity of the tube 12 forming a first inflatable chamber 20, and a second inflatable chamber 22. It will be noted that the internal portions 18*a*, 18*b*, are disposed within tube 12 such that the first inflatable chamber 20 is not in fluid communication with the second inflatable chamber 22. The internal partitions 18*a*, 18*b* offer a safety advantage in that if one chamber 20, 22 looses air and deflates, due to a puncture, the other chamber 20, 22 will remain inflated ensuring a portion of the inflatable shell 12 remains buoyant. As known, it is conceivable that a plurality of partitions could be disposed internally within tube 12 to form a plurality of inflatable chambers, if desired. Air is introduced or removed from each inflatable chamber 20, 22 by a first valve 24 that is in fluid communication with the first inflatable chamber 20, and a second valve 26 that is in fluid communication with the second inflatable chamber 22.

With continued reference to FIG. 1, the inflatable tube 12 further includes a base member 28 forming a floor. In one embodiment of the present invention, base member 28 includes a durable, flexible rubber, or plastic sheet material that is securely adhered to the lower or bottom inside surface of the inflatable tube 12. In one non-limiting example, base member 28 is welded two-thirds, or three-fourths the way down on the inside of the inflatable tube 12. The base member 28 may be attached to the inside surface of the inflatable tube 12 by glue, adhesive, rubber cement, heat, high-frequency electrical welding techniques or any other suitable methods known in the art. As illustrated, base member 28 includes a plurality of drainage holes 30. Each drainage hole 30 is formed completely through base member 28 to allow water to drain through. Each drainage hole 30 may comprise any shape, size and dimension, and may be formed anywhere on base member 28.

Inflatable pontoon 12 includes a plurality of cleats 32*a*, 32*b*, 32*c*, 32*d*. In a preferred embodiment, each cleat 32*a*, 32*b*, 32*c*, 32*d* is located proximate the four corners of pontoon 12. Cleats 32*a*, 32*b*, 32*c*, 32*d* may be constructed from a hard, durable rubber, metal, stainless steel, or other suitable material. It will be noted that a reinforcement material or patch may be used to enhance the structural stability of each cleat 32*a*, 32*b*, 32*c*, and 32*d*, if desired. Alternatively, each cleat 32*a*, 32*b*, 32*c*, 32*d* may comprise grippers, apertures, fasteners, or rings for attaching a tether arrangement 16, 16*a* thereto, as better illustrated in FIG. 3.

A bumper 34 or guard is disposed completely around or along the outer edge or perimeter of inflatable pontoon 12. The bumper 34 acts as a side shock absorber when the inflatable tube or pontoon 12 butts against the side of a vessel V. The bumper or guard 34 may comprise a rubber or foam like material.

Floatable workstation 10 further includes a deck assembly 14. In one non-limiting example, deck assembly 14 includes three deckboards 15*a*, 15*b*, 15*c*, forming floorboard 36, as better illustrated in FIG. 2. Each deckboard 15*a*, 15*b*, 15*c* is releasably assembled together by an interlocking fastener. In one exemplary embodiment, the interlocking fastener comprises a tongue 17*a*, 17*b* and groove 19 and 21. The deckboards 15*a*, 15*b*, 15*c* are assembled together such that the tongue 17*a* fits within groove 19, and tongue 17*b* fits within groove 21 forming floorboard 36, as better illustrated in FIG. 4. However, other interlocking fasteners may be used such as clips, pegs and apertures, snap-ins, clamps, or the like. Deckboards 15*a*, 15*b*, 15*c* are generally lightweight, rigid, and may include a resin or friction material that is applied to the outer surface of each deckboard 15*a*, 15*b*, 15*c* to provide non-skid, or non-slip features. Deckboards 15*a*, 15*b*, 15*c* may be formed from a sheet of plywood, marine plywood, slats, a rigid plastic, or other known materials, and should be shaped and sized to fit within the floor recess of inflatable pontoon 12. Thus, deck assembly 14 should correlate with the shape and size of the inflatable pontoon 12.

In one non-limiting example, deck assembly 14 has been described as including a plurality of deckboards 15*a*, 15*b*, 15*c* assembled together to form a single floorboard 36. It will be contemplated that deck assembly 14 may comprises one or more boards that are shaped, sized and configured to be secured within the inflatable pontoon 12. Preferably, deckboards 15*a*, 15*b* and 15*c* are assembled together and releasably secured to the top of the inflatable pontoon 12, as is better illustrated in FIG. 3. It will be noted that deck assembly 14 may comprise a single rectangular piece of marine plywood that is shaped and sized to fit on top of the pontoon 12, or within the floor recess of pontoon 12. In one non-limiting example, deck assembly 14 may comprise a single 8×4 piece of marine plywood. The combinational characteristics of both the thickness of the deck assembly 14, and the inflatable buoyant state of inflatable tube 12, should be selected to provide a rugged floatable workstation 10 configured to hold the weight of a selected amount of people.

Figure 2:
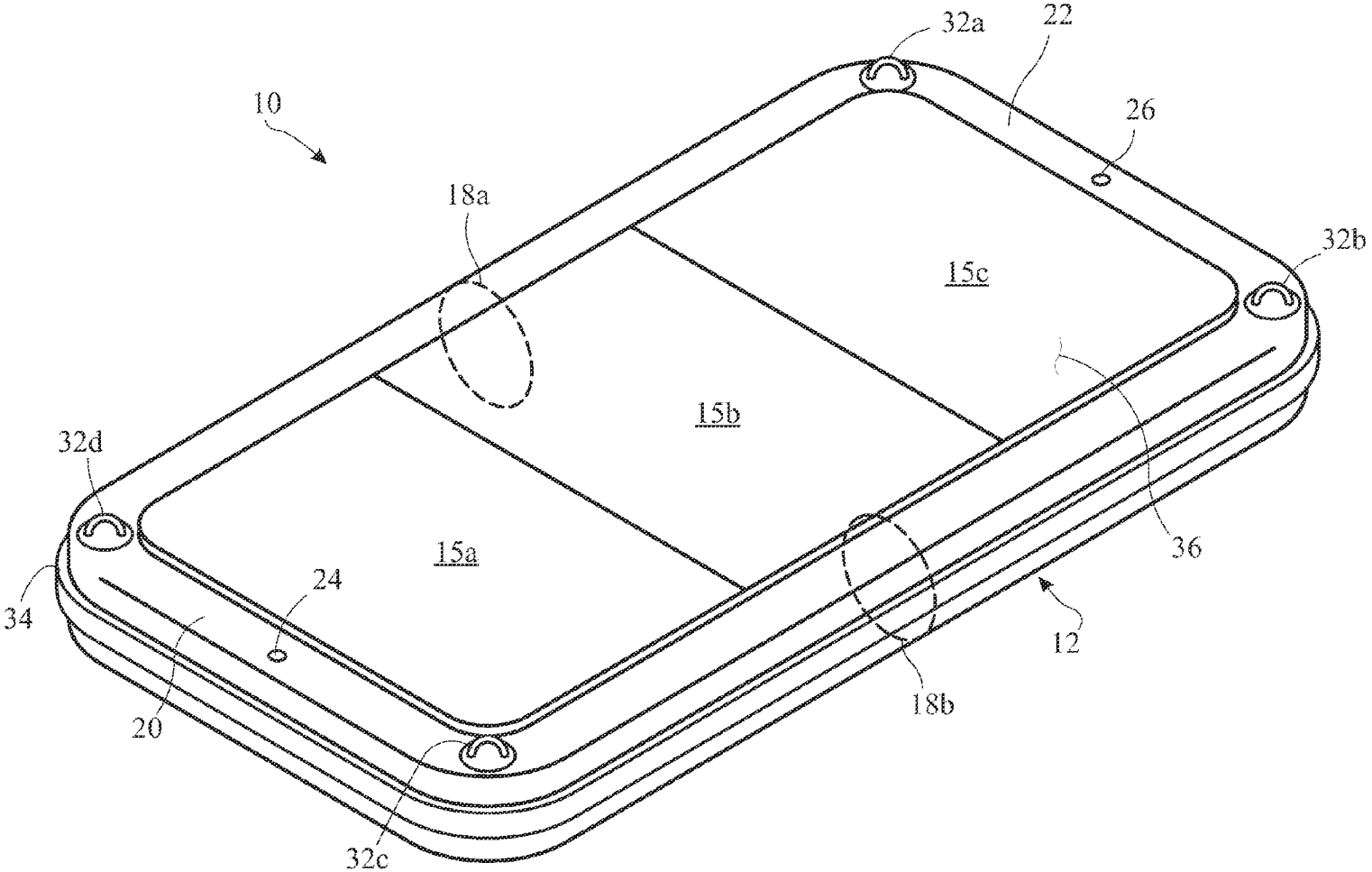
FIG. 2 shows a top perspective view of the floatable workstation of FIG. 1, operatively assembled together.

Referring to FIG. 2, there is shown a top perspective view of an assembled floatable workstation 10, according to the present invention. Deck assembly 14 comprises deckboards 15*a*, 15*b*, 15*c* that are assembled together to form floorboard 36. Floorboard 36 is placed within the floor recess of the inflatable pontoon 12. When the pontoon 12 is fully inflated, the sidewalls of pontoon securely holds floorboard 36 in place. Alternatively, floorboard 36 may be releasably attached to the inflatable pontoon 12 using appropriate fastening means. As illustrated, deck assembly 14 provides a rigid support surface or floorboard 36 for the inflatable workstation 10 permitting one or more persons to stand on top of the floatable workstation 10.

Figure 3:
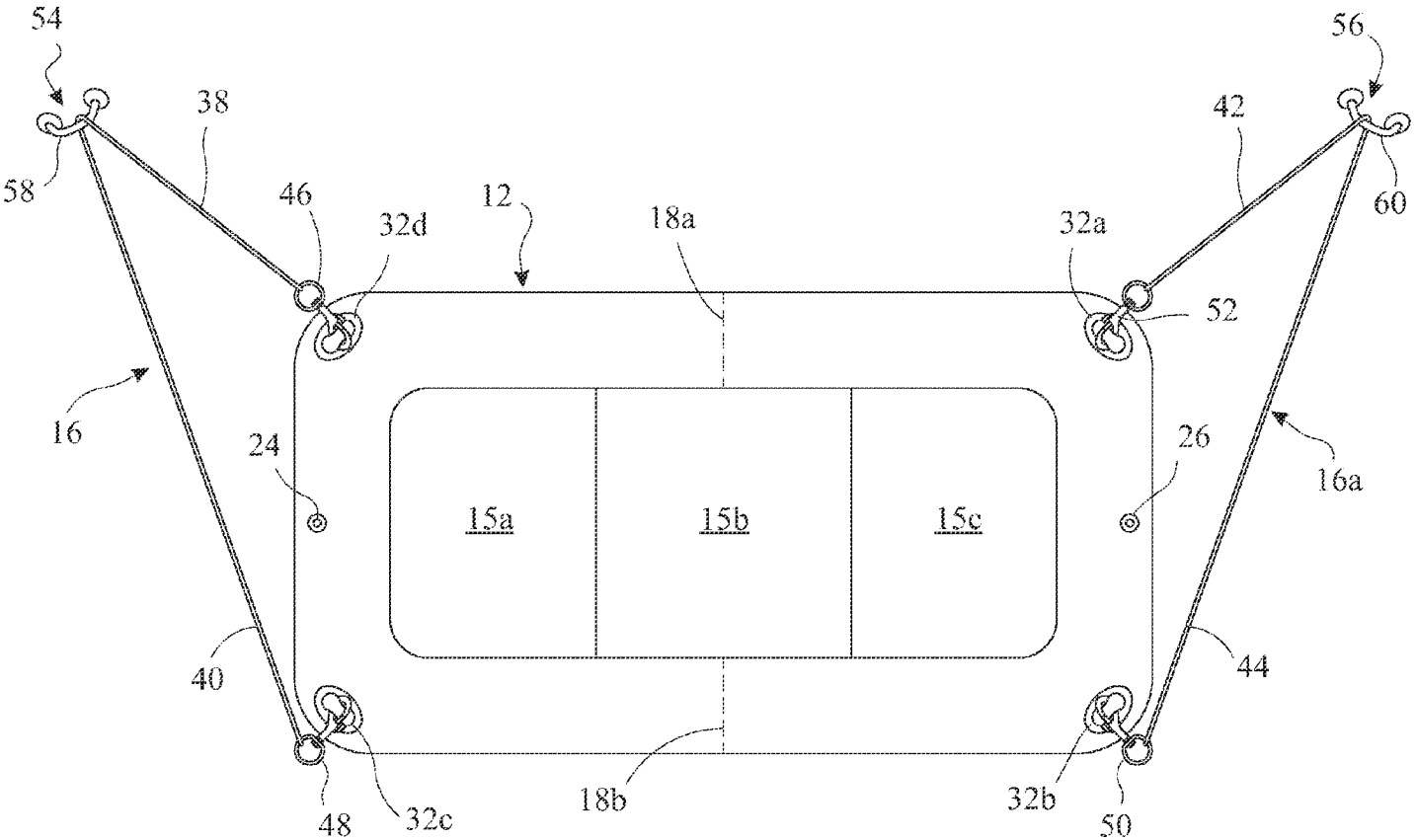
FIG. 3 shows a top view of the floatable workstation of FIG. 2, including a tether arrangement, according to an embodiment of the present invention.

Turning now to FIG. 3, there is shown a top view of the floatable workstation 10, of FIG. 2, including a tether arrangement 16, 16*a*, according to the present invention. Tether arrangement 16 comprises tethers 38, 40; a means for fastening 46, 48 disposed at one end of each tether 38, 40; and a suction mechanism 54. Tether arrangement 16*a* comprises tethers 42, 44; a means for fastening 50, 52 disposed at one end of each tether 42, 44; and a suction mechanism 56.

Tethers 38, 40, 42, 44 may comprise any one of webbing straps, rope, cords, elastic tubes, straps, braids, wires, chains, bungee cords, nylon straps, rubber strips or strands, strings, belts, bands or the like. Each tether 38, 40, 42, 44 may include an adjusting means for adjusting the length of each tether 38, 40, 42 and 44. Examples of adjusting means may include buckles, web slides, hook and loop fasteners, or the like. Thus, the floatable workstation 10 could be anchored alongside vessel V, in desired orientation and position with respect to the vessel V, by adjusting the lengths of the tethers 38, 40, 42 and 44, if desired.

A means for fastening 46, 48, 52, 50 each tether 38, 40, 42, 44 to a corresponding cleat 32*d*, 32*c*, 32*b*, 32*a*, respectively, to inflatable pontoon 12, may include any one of clamps, spring clips, clips, quick release buckles, snaps, rings, snap rings, spring hooks, carabineers, hook and loop fasteners, couplings, clasps, spring biased clasps, S-hooks, spring detents, swivel fasteners, magnets, or other suitable means for attaching.

Suction mechanism 54, 56 generally comprises one or more suction cups attached to a corresponding connecting member 58 and 60, respectively. Each suction mechanism 54, is readily attached to the side surface of a vessel V such that each suction cup is compressed against the vessel's surface to create a vacuum so that each suction mechanism 54, 56 is operatively secured to the side of the vessel V. The suction cups provide the convenience of easily repositioning the suction mechanism 54, 56 anywhere along the outer side surface of the vessel V. Tethers 38, 40, 42, 44 may be releasably attached to each corresponding suction mechanism 54, 56 by fasteners or connectors, or alternatively, tethers 38, 40, 42, 44 may be looped around each connecting member 58, 60 of each suction mechanism 54, 56.

It will be noted that each tether 38, 40, 42, 44 may be connected to each suction mechanism 54, 56 using a variety of connectors including but not limited to clamps, spring clips, clips, quick release buckles, snaps, rings, snap rings, spring hooks, carabineers, hook and loop fasteners, couplings, clasps, S-hooks, spring detents, swivel fasteners, magnets, or any combination thereof.

Figure 4:
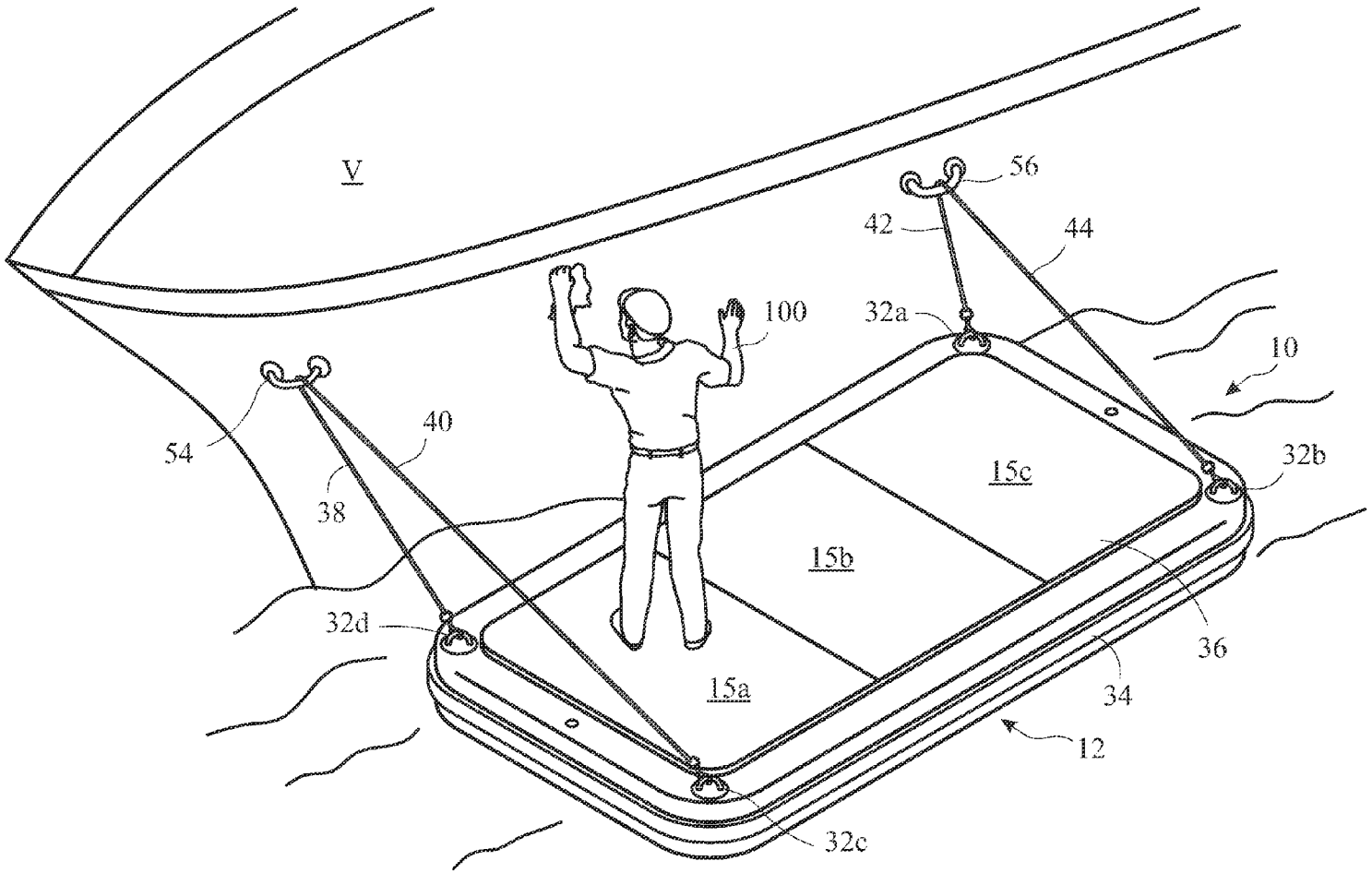
FIG. 4 shows a perspective operative view of the floatable workstation, according to the present invention.

Turning now to FIG. 4, there is shown a perspective operative view of the floatable workstation 10 positioned alongside a vessel V, according to the present invention. For illustrative purposes, reference is made to FIGS. 1 through 5 to show the operative assembly and use of floatable workstation 10.

In assembly, air is introduced into each chamber 20, 22, via valves 24, 26, to semi-inflate each chamber 20 and 22. Deck boards 15*a*, 15*b*, 15*c* are assembled together by inserting tongue 17*a* into groove 19, and tongue 17*b* into groove 21 forming a rigid floorboard 36, as illustrated in FIG. 2. Floorboard 36 is inserted within the floor recess of inflatable pontoon 12. Subsequently, each chamber 20, 22 is fully inflated so that the walls of pontoon 12 securely hold or lock floorboard 36 in place. Alternatively, floorboard 36 may be releasably attached to pontoon 12 using appropriate attachments or fasteners.

With reference to FIG. 3, a tether arrangement 16, 16*a* is securely attached to floatable workstation 10 such that tethers 38, 40, 42, 44 are releasably attached to a corresponding cleat 32*d*, 32*c*, 32*b*, 32*a*. Another end of tethers 38, 40, 42, 44 are attached to suction mechanisms 54, and 56.

Turning again to FIG. 4, once floatable workstation 10 has been assembled together and securely fixed to the side of vessel V, one or more persons 100 can stand on floorboard 36 of floatable workstation 10 to access the outer surfaces of the vessel V. The person 100 may selectively position each suction mechanism 54, 56 along the side surface of vessel V by compressing the suction cups against the surface of vessel V. Optionally, if the tethers 16, 16*a* include a means of adjusting the length of each tether 38, 40, 42, 44 the person 100 may make the necessary adjustments, if desired. Tether arrangements 16, 16*a* are adapted to control the floatable workstation 10 in a longitudinal and transverse direction in relation to the vessel V. As shown, floatable workstation 10 is held securely in position alongside vessel V by suction mechanisms 54, and 56. Once the floatable workstation 10 is in a desired position, crew member 100 is able to conduct maintenance on the side surface of the vessel V, such as repairing, painting, waxing, buffing, or washing. Bumper 34 provides protection should the workstation 10 butt against the side surface of the vessel V, or boats, docks or other objects.

The suction mechanisms 54, 56 allows the crew member 100 to easily modify the position of the floatable workstation 10 by simply repositioning the mechanisms 54, 56 along side the outer surface of the vessel V.

Figure 5:
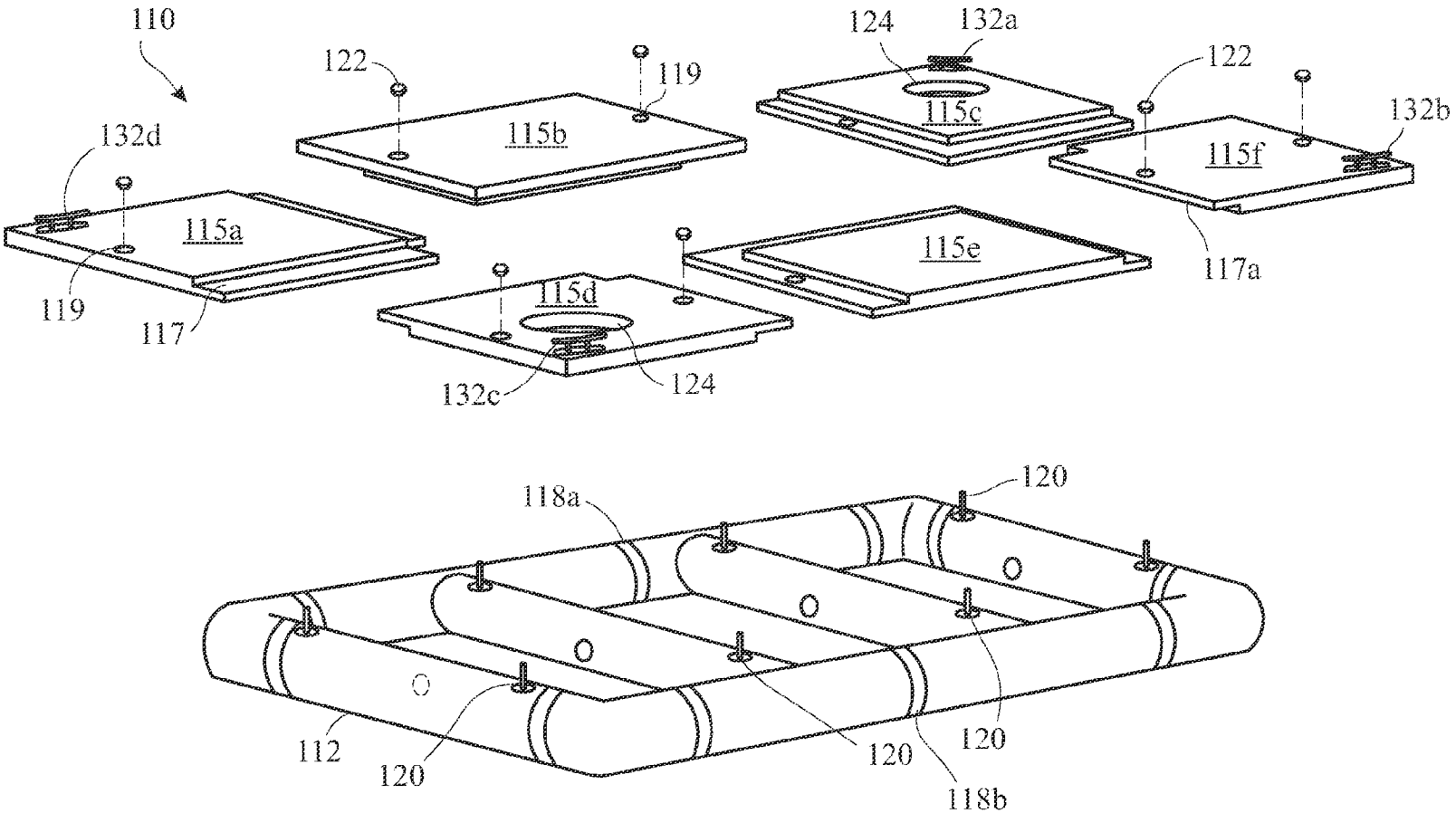
FIG. 5 shows an exploded perspective view of a floatable workstation, according to an alternative embodiment of the present invention.

Turning now to FIG. 5, there is shown an exploded perspective view of a floatable workstation 110, according to an alternative embodiment of the present invention. The floatable workstation 110 includes an inflatable tube 112, and a plurality of deckboards 115*a*, 115*b*, 115*c*, 115*d*, 115*e*, 115*f* assembled together to form a floorboard 136. Floorboard 136 is releasably secured on top of inflatable tube 112, as better illustrated in FIG. 6.

In the exemplary embodiment, inflatable tube 112 includes internal partitions 118*a*, 118*b* and 118*c*. Each internal partition 118*a*, 118*b*, 118*c* is fixedly disposed internally within the air receiving cavity of tube 112. As described above in reference to FIG. 1, each partition 118*a*, 118*b*, 118*c* is configured to block a cross-sectional area of the internal air receiving cavity of tube 112 forming separate individual inflatable chambers. It will be noted that inflatable tube 112 may include a plurality of internal partitions to form a plurality of inflatable chambers. The plurality of inflatable chambers offers the advantage of allowing floatable workstation 110 to remain a float should one or more inflatable chambers burst.

Tube 112 also includes a plurality of attachments 120. Each attachment 120 is disposed on the top surface of tube 112 for releasably attaching deckboards 115*a*, 115*b*, 115*c*, 115*d*, 115*e*, 115*f* securely on top of the tube 112. In the exemplary embodiment, each attachment 120 comprises a threaded bolt, and a corresponding nut 122. As shown, each bolt 120 extends vertically upwards from the tube 112, and each bolt 120 is aligned to be inserted within a corresponding aperture 119 of each deckboard 115*a*, 115*b*, 115*c*, 115*d*, 115*e* and 115*f*. It will be noted that attachments 120 may comprise a variety of other suitable attachments including but not limited to screws, rods and pins, clamps, clips, or hook and loop fasteners.

As illustrated in FIG. 5, each deckboard 115*a*, 115*b*, 115*c*, 115*d*, 115*e* 115*f* includes an interlocking means 117, 117*a* for securely assembling the deckboards 115*a*, 115*b*, 115*c*, 115*d*, 115*e*, 115*f* together to form a single floorboard 136. The interlocking means 117, 117*a* may include any one of tongue and groove, fasteners, hook and loop fasteners, releasable interlocks, snap fittings or the like. Further, each deckboard 115*a*, 115*b*, 115*c*, 115*d*, 115*e*, 115*f* includes at least one aperture 119 completely formed through the board for correspondingly receiving a threaded bolt 120.

One or more cleats 132*a*, 132*b*, 132*c*, 132*d* are located on deckboards 115*c*, 115*f*, 115*d*, and 115*a*, respectively. Preferably, cleats 132*a*, 132*b*, 132*c*, 132*d* are located proximate the four corners of tube 112 and configured for correspondingly receiving a tether arrangement 16, 16*a*, as shown earlier in FIG. 3. Each cleat 132*a*, 132*b*, 132*c*, 132*d* may comprise any size and shape and may include a re-enforcement material to enhance the structural stability and use of the cleats 132*a*, 132*b*, 132*c* and 132*d*.

According to one embodiment of the present invention, at least one deckboard 115*c* includes an indentation or shallow receptacle 124 for removeably storing a bucket therein. The indentations 124 include loop fasteners that attachably correspond to hook fasteners attached to the bottom of the storage bucket. The loop and hook fasteners are releasably attached together to advantageously prevent the storage bucket from sliding on the floatable workstation. The loop and hook fasteners prevent the storage bucket from sliding when the floatable workstation 110 is exposed to rough waters, or prevents the storage bucket from accidentally bumping into or by workmen standing on the floatable workstation 110.

Figure 6:
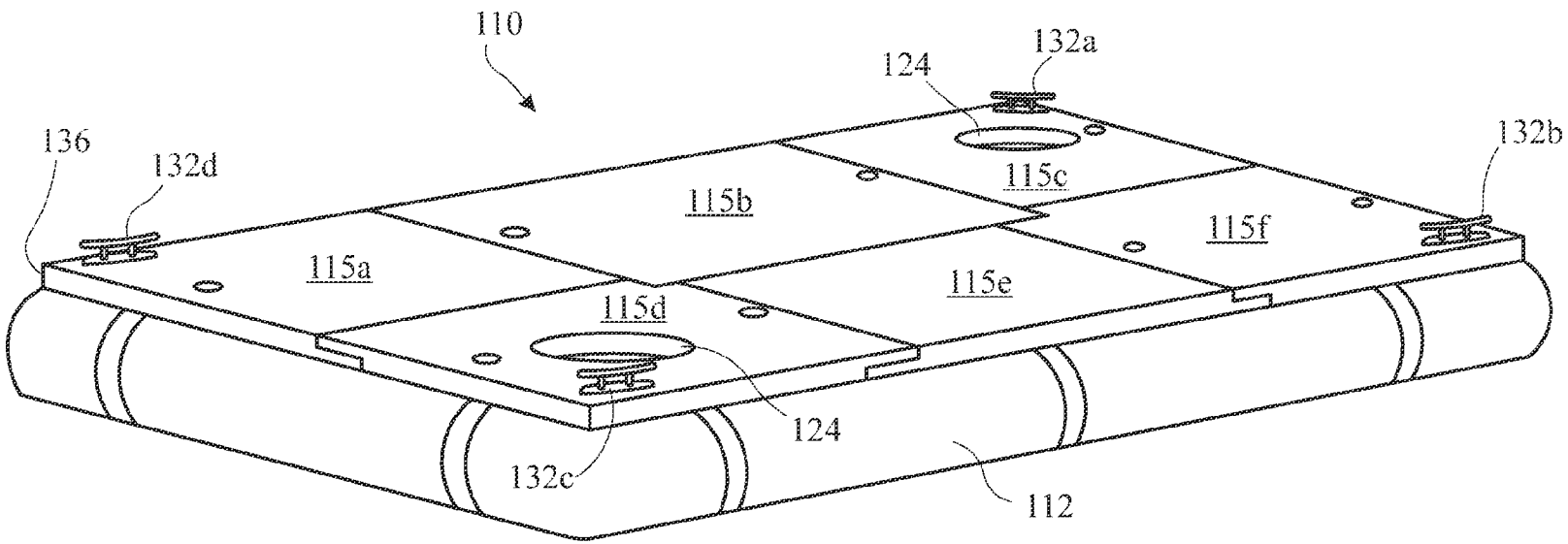
FIG. 6 shows a perspective view of the floatable workstation of FIG. 5 assembled, according to the alternative embodiment.

Turning now to FIG. 6, there is shown a perspective view of the floatable workstation 110 of FIG. 5 shown assembled, according to the alternative embodiment of the present invention. As shown, deckboards 115*a*, 115*b*, 115*c*, 115*d*, 115*e*, 115*f* are assembled together, via, interlocking means 117 and 117*a*. The assembled deckboards 115*a*, 115*b*, 115*c*, 115*d*, 115*e*, 115*f* are placed on top of tube 112 so that each bolt 120 correspondingly extends through each aperture 119. Nuts 122 are correspondingly threaded onto each bolt 120 for securely attaching deckboards 115*a*, 115*b*, 115*c*, 115*d*, 115*e*, 115*f* on top of tube 112 forming deck assembly 136 for workmen to stand on. Upon assembly, a tether arrangement 16, 16*a*, as illustrate earlier in FIG. 3, may be releasably attached to cleats 132*a*, 132*b*, 132*c* and 132*d* for positioning the floatable workstation 110 along side a vessel V.

The floatable workstation 10, 110 of the present invention can be easily disassembled, stored, or carried and transported in a carrying bag, if desired. With reference to FIGS. 1 through 3, 5 and 6, floatable workstation 10, 110 can be easily disassembled by releasably detaching tether arrangement 16, 16*a* from each corresponding cleats 32*a*, 32*b*, 32*c*, 32*d*, 132*a*, 132*b*, 132*c* and 132*d*. In one embodiment, any excess water that has collected within the floor recess of the pontoon 12 drains through drainage holes 30.

The inflatable chambers 20, 22, are deflated, via, valves 24, 26, respectively, allowing the side walls of the pontoon 12, 112 to collapse. Floorboard 36 is removed from the floor space of pontoon 12, or alternatively floorboard 136 is detached from the top of tube 112. Floorboard 36 is disassembled by disengaging or unlocking deckboards 15*a*, 15*b*, 15*c*. In the alternative embodiment, each nut 122 is removed from each corresponding bolt 120, and each deckboard 115*a*, 115*b*, 115*c*, 115*d*, 115*e*, 115*f* removed from the top of tube 112 allowing each bolt 120 to slide out from each corresponding aperture 119. With deckboards 15*a*, 15*b*, 15*c*, 115*a*, 115*b*, 115*c*, 115*d*, 115*e*, 115*f* fully removed, pontoon 12, 112 is deflated and easily folded or rolled-up for proper storage and transport.

The floatable workstation 10, 110 of the present invention offers the advantages in that it permits a person to work alongside the outer surface of a vessel V, is easy to assemble, use, and disassemble, includes a tether arrangement that is adapted to control a floatable workstation 10, 110 in a longitudinal and transverse direction in relation to a vessel V, and can be conveniently transported, if desired. It will be noted that the present invention is not limited to working on a vessel. Other applications for the floatable workstation of the present invention may include a platform for swimmers, a platform to engage in sporting activities such as fishing, diving, golfing or skeet shooting, or a floatable platform for whale watching or the like.

Figure 10:
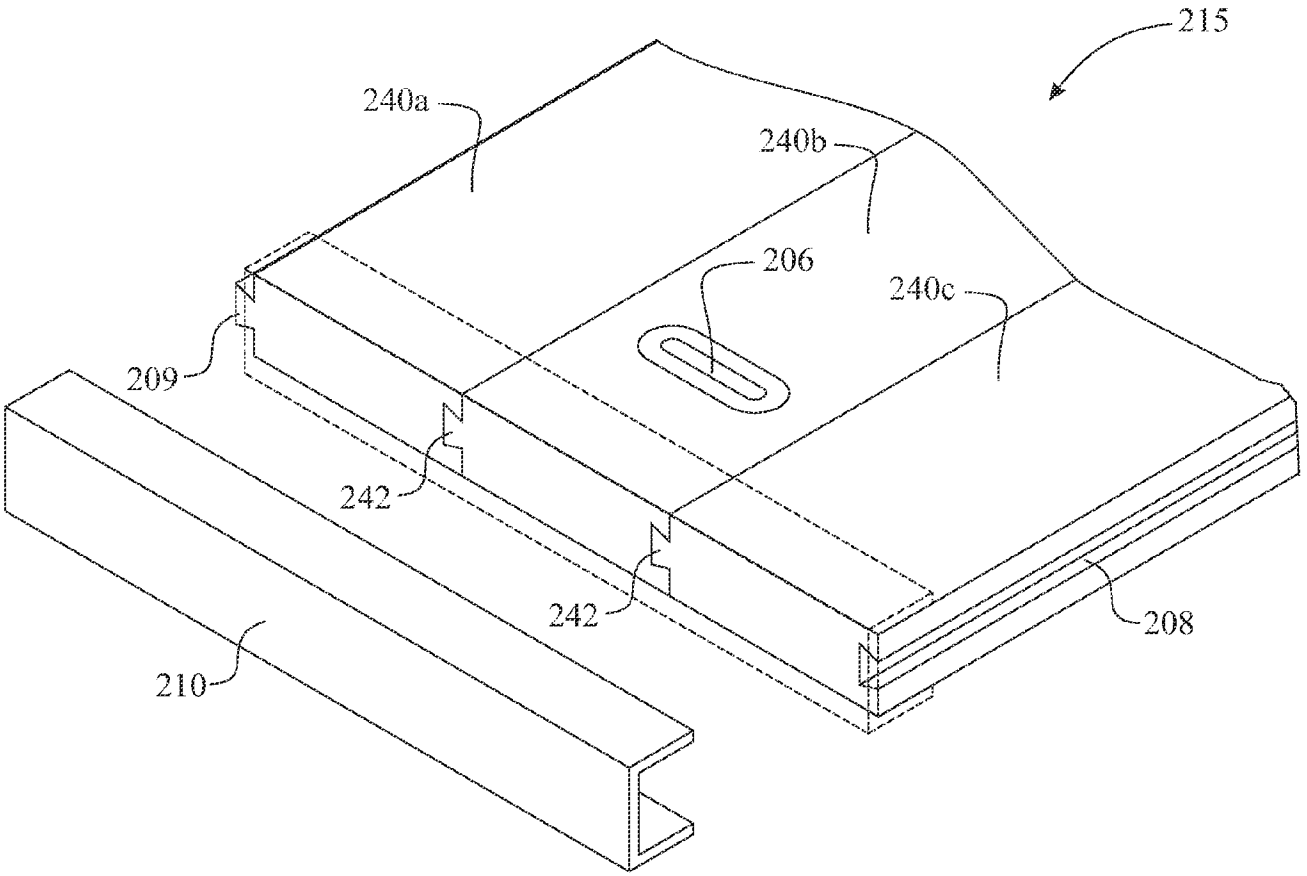
FIG. 10 shows an exemplary embodiment of a deckboard assembly.
Figure 11:
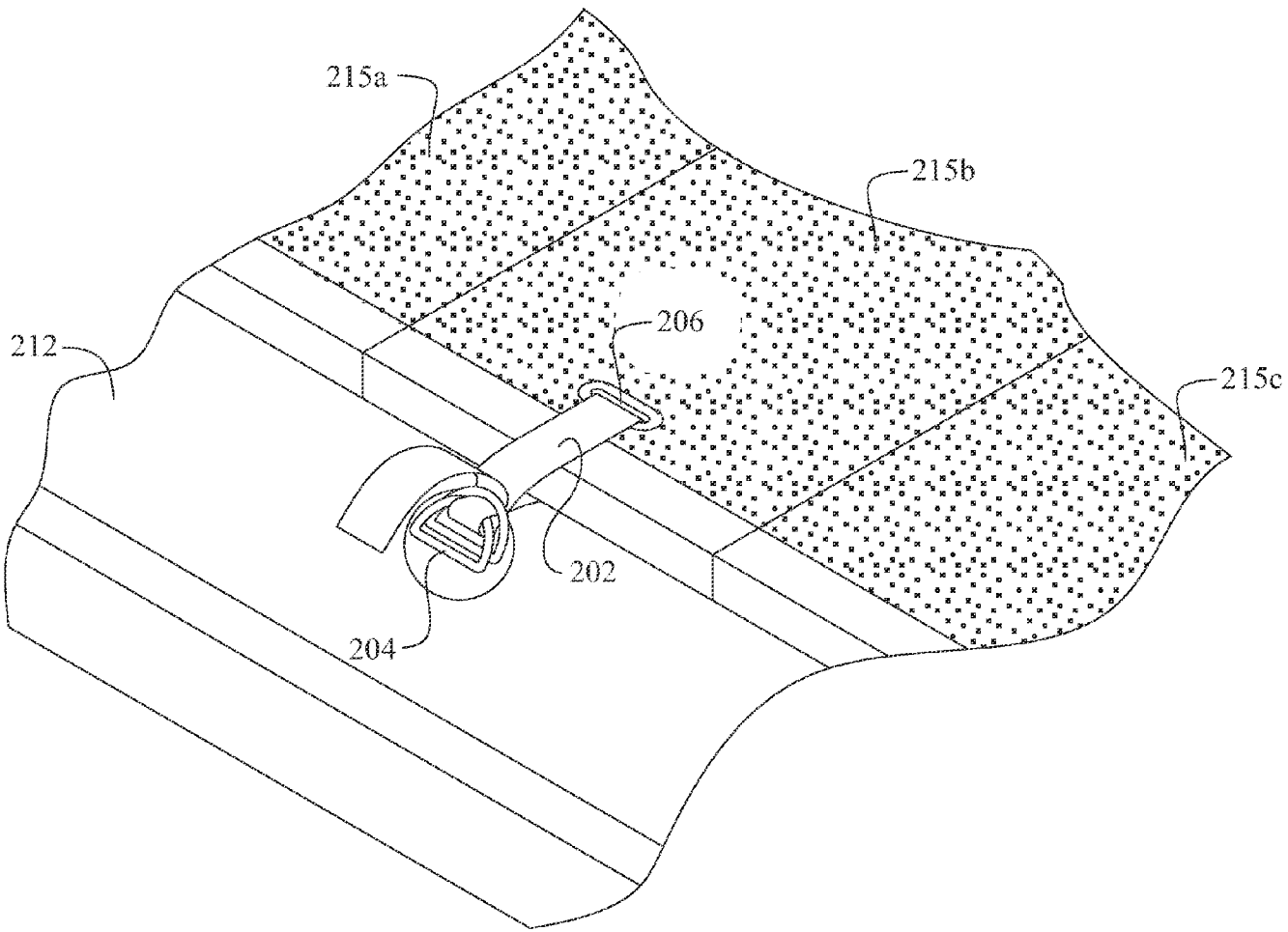
FIG. 11 shows an exemplary embodiment of a deckboard securing tether.

An alternate exemplary embodiment is presented in FIGS. 7 through 12. The assembled floatable workstation 200 is presented in FIG. 7, with the exploded assembly view shown in FIG. 8. The interlocking deck design is best presented in FIG. 9. An exemplary assembly of each individual deckboard is illustrated in FIG. 10. Details of the deckboard attachment means are presented in FIG. 11.

An assembly of a plurality of deckboards 215*a*, 215*b*, 215*c*, 215*d*, 215*e*, 215*f*, provides a work platform 236. The work platform 236 is then secured to an upper surface of the inflatable workstation base 212 via a plurality of deckboard securing straps 202. The inflatable workstation base 212 is similar to the first inflatable chamber 20, 22 previously described herein. At least one inflation valve 224 can be provided as a means for providing air into each air receiving chamber. Additionally at least one inflatable support chambers 213 can be disposed within a perimeter of the inflatable workstation base 212 providing additional buoyancy and support to the work platform. The deckboard securing straps 202 are secured to respective d-rings 204, threaded through a strap receptacle 206 of the interlocking deckboards 215, and looped back through the same d-rings 204. The preferred embodiment provides a strap receptacle 206 on each of the outer edges of the interlocking deckboards 215 and one deckboard securing straps 202 respective to each strap receptacle 206. A first end of the deckboard securing straps 202 is secured to the d-rings 204. A second (unsecured) end of the deckboard securing straps 202 is threaded through the respective strap receptacle 206 and secured to the d-rings 204. Details of the securing configuration are presented in FIG. 11.

Each interlocking deckboards 215 incorporates an interlocking slot 208 along a centerline of a first elongated edge. Each interlocking deckboards 215 includes an interlocking tail 209 along a centerline of a second (or opposing) elongated edge. The preferred embodiment utilizes a sliding dovetail for the interlocking slot 208 and interlocking tail 209. Although a symmetric design is presented, it is recognized that any interlocking design can be used, including designs which secure via a longitudinal sliding motion, a vertical insertion motion, and the like. Although a dovetail is commonly known as a trapezoidal shape, the term can be applied to any interlocking configuration having a wider inset and a narrower edge to provide a tensile strength.

Each interlocking deckboards 215 can be assembled via a plurality of deckboard submember 240, the exemplary embodiment having three deckboard submember 240*a*, 240*b*, 240*c*. The three deckboard submember 240*a*, 240*b*, 240*c* can be assembled via permanently coupling a deckboard subassembly interlocks 242. A deckboard end members 210 can then be assembled to each end of the interlocking deckboards 215. The deckboard end members 210 can be machined, providing clearance for the interlocking slot 208 on one of the two ends of the interlocking deckboards 215. The interlocking tail 209 would remain exposed on both ends of the interlocking deckboards 215. A texture can be applied to each of an upper and lower surface of the interlocking deckboards 215 to help the user during use. The texturing can be applied to conceal the seam provided by the deckboard subassembly interlocks 242. Other features such as the strap receptacle 206 and the deckboard end members 210 can be taped prior to application of the texturing to provide a contrast or left exposed to conceal the features.

Additional features can be incorporated for reliability and convenience. One such feature is a midriff roping 234 placed about a waistline of the inflatable workstation base 212 The midriff roping 234 is assembled via threading said midriff roping 234 through a plurality of midriff rope attachments 232, the midriff rope attachments 232 being adhered to an outer wall of the inflatable workstation base 212. A preferred midriff rope attachments 232*a* is adhered to each of the four corners of the inflatable workstation base 212, thus maintaining the midriff roping 234 about the four corners of the inflatable workstation base 212. A shallow receptacle 226 can be incorporated into at least one of the interlocking deckboards 215 providing a means for securely maintaining a bucket or similar object.

Figure 7:
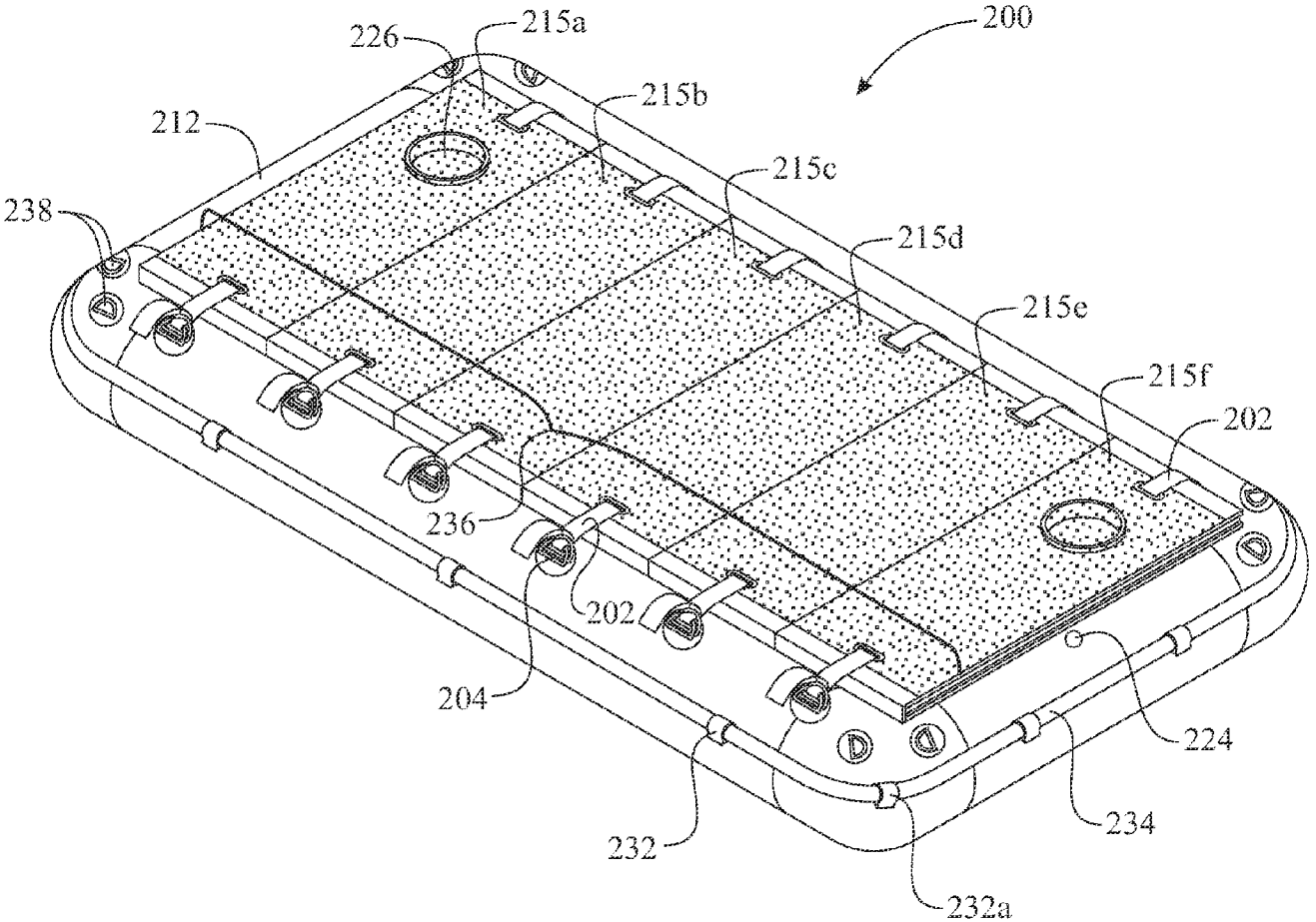
FIG. 7 shows a perspective, assembled view of an alternate exemplary embodiment of the floatable workstation incorporating an interlocking deckboard design and a tether deck tie down configuration.
Figure 8:
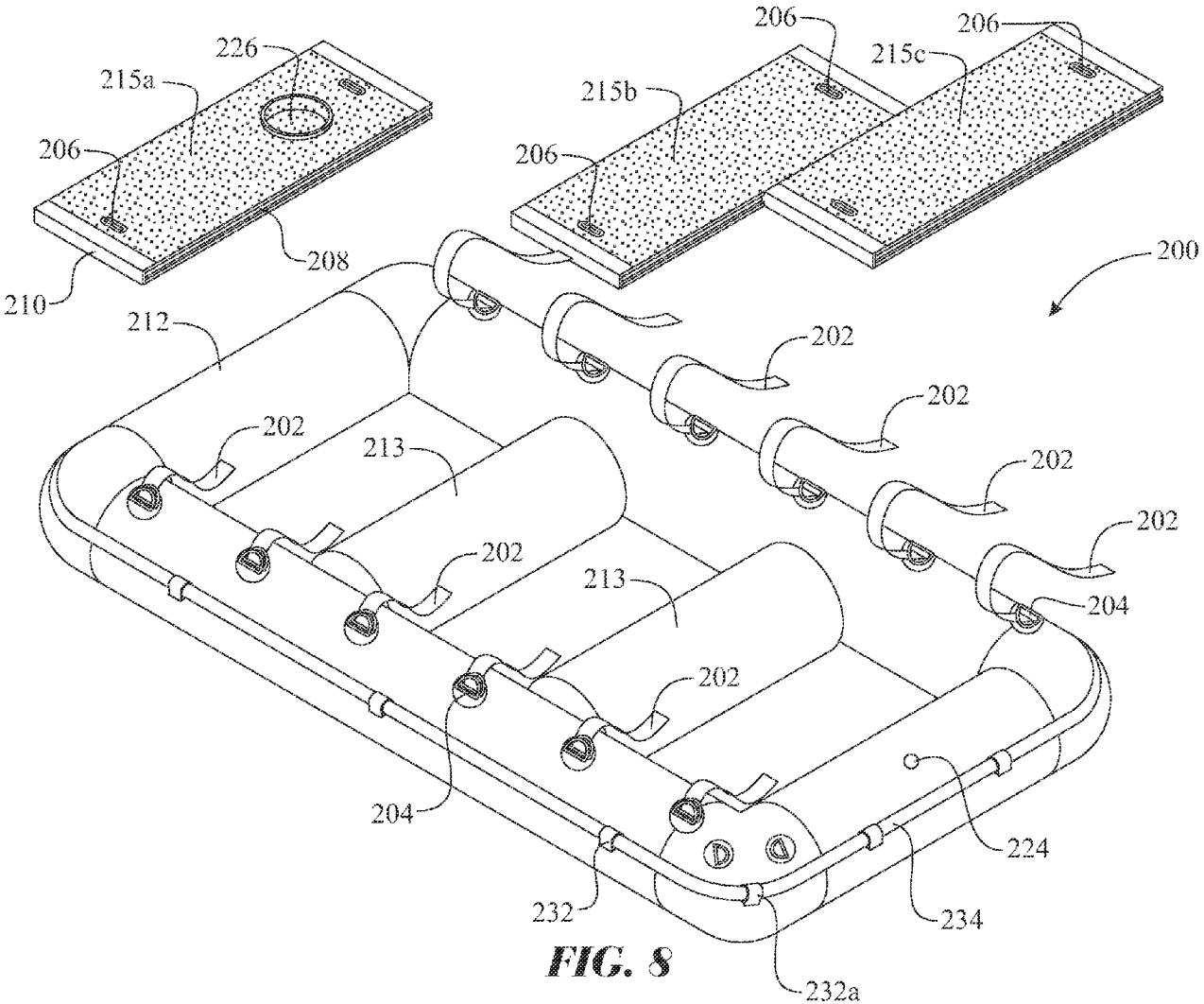
FIG. 8 shows a perspective, exploded assembly view of an alternate exemplary embodiment of the floatable workstation.
Figure 9:
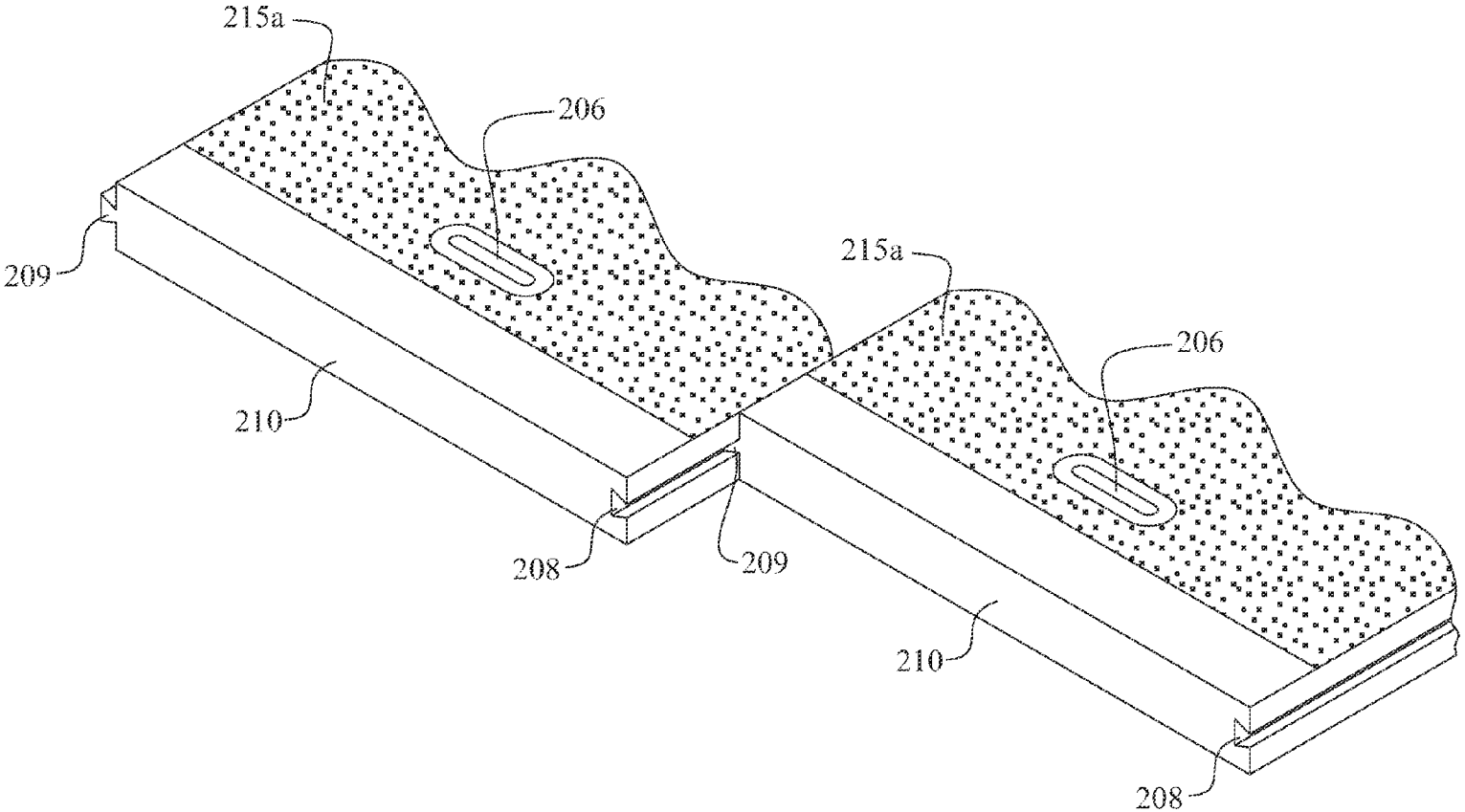
FIG. 9 shows a detailed view illustrating the interlocking deckboard design.

The floatable workstation 200 preferably includes a plurality of corner fastening members 238 disposed on at least one of the inflatable workstation base 212 and the work platform 236. The corner fastening members 238 is attached to each corner of the inflatable workstation base 212, with the preferred embodiment having two fasteners 238 at each corner as illustrated in FIG. 7.

Multiple workstations can be co-joined as presented in FIGS. 12 through 16.

Figure 12:
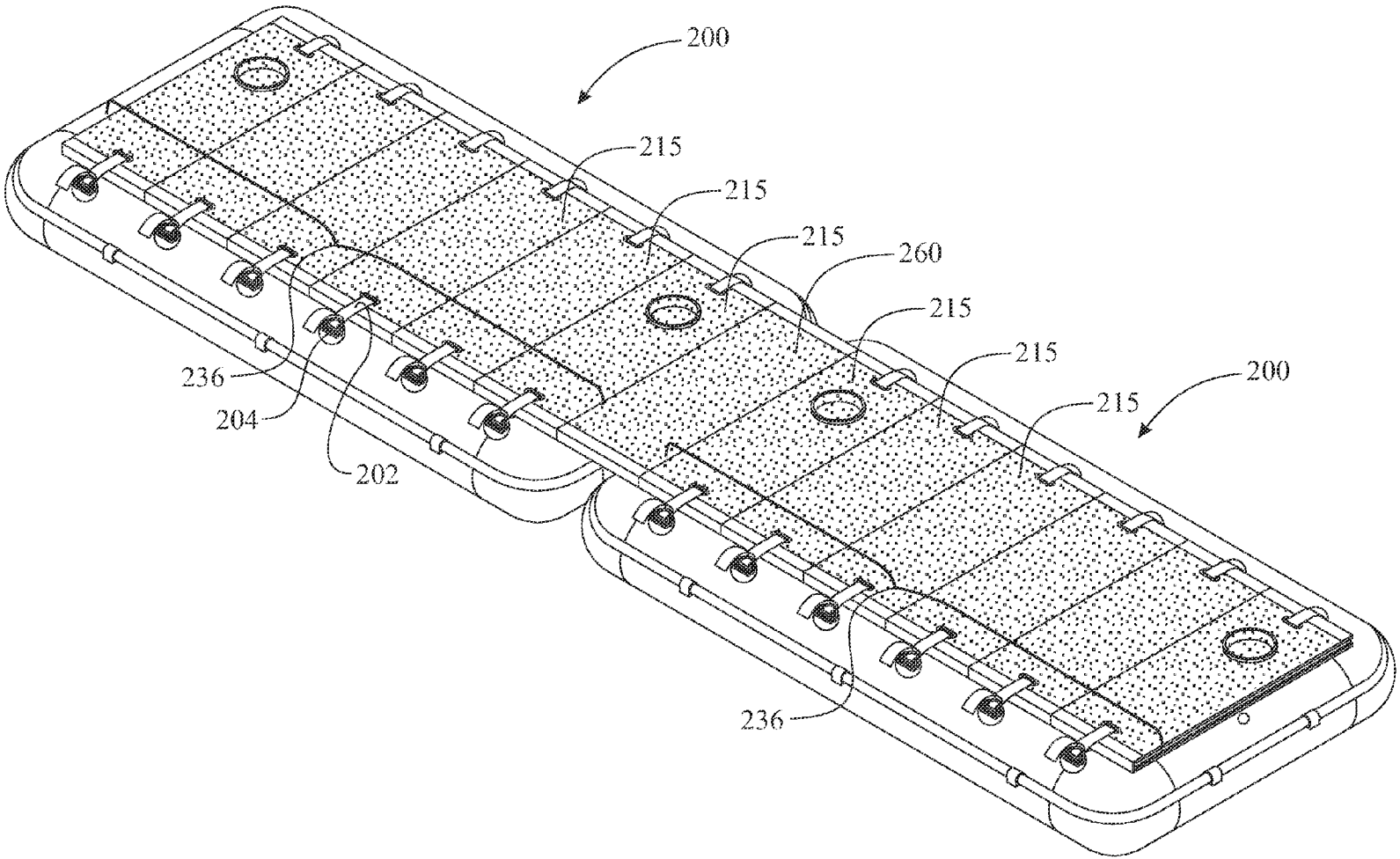
FIG. 12 shows a longitudinal inter-workstation coupling configuration.

A first co-joining embodiment utilizes an interworkstation coupling deckboard 260 assembled between two end interlocking deckboards 215 of a first and a second floatable workstation 200, as best illustrated in FIG. 12. The interworkstation coupling deckboard 260 would be assembled between the two workstations 200 utilizing the same coupling system used between the interlocking deckboards 215. The interworkstation coupling deckboard 260 is preferably the same elongated length as the deckboards 215, while having a width as required to span the provided gap between the two work platforms 236. This interface configuration provides a secure and substantially rigid work platform 236.

Figure 13:
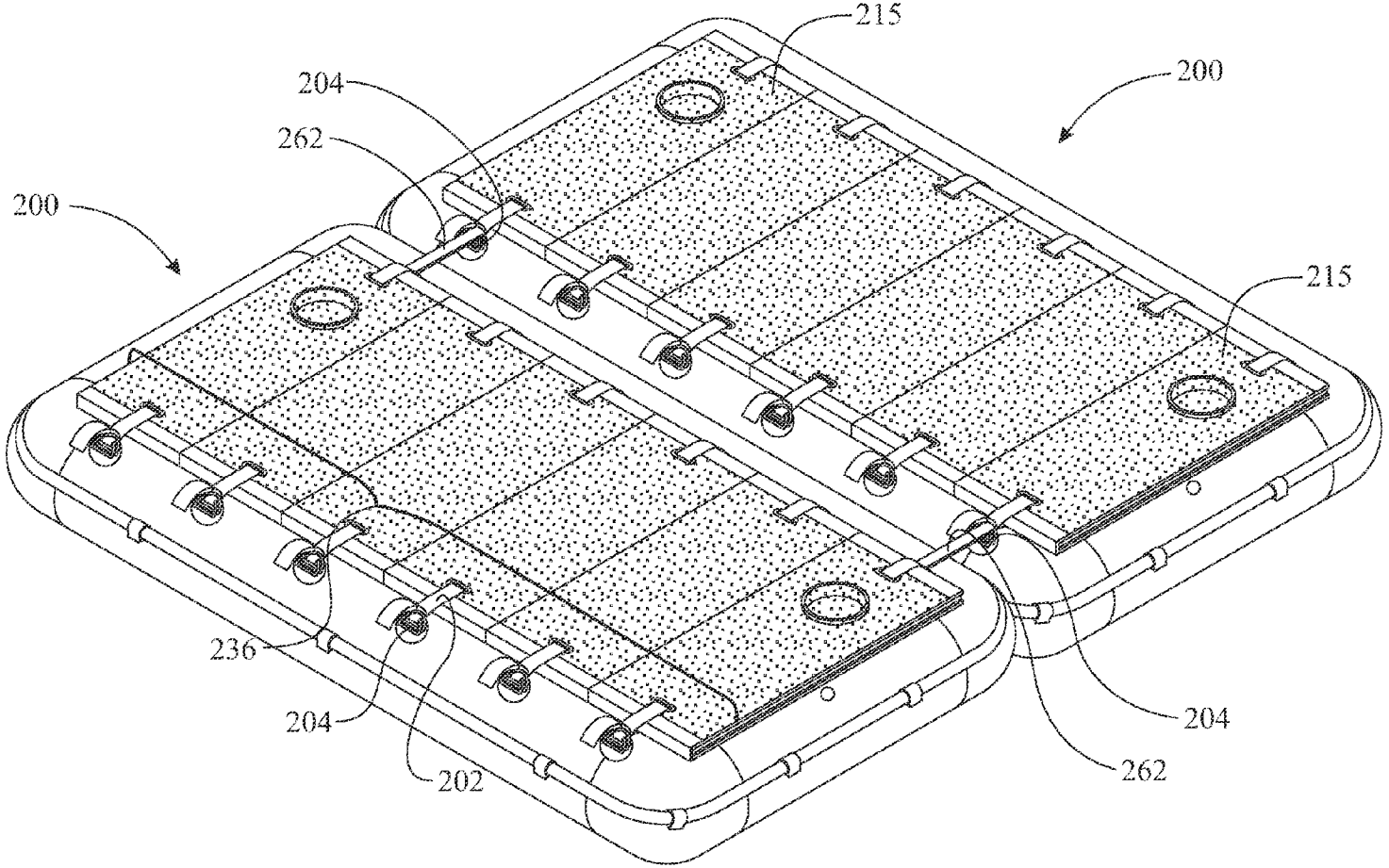
FIG. 13 shows an alternate longitudinal inter-workstation coupling configuration.

A second co-joining embodiment utilizes a plurality of interworkstation coupling tether 262 assembled between two adjacent d-rings 204 of the first and second floatable workstation 200, as best illustrated in FIG. 13. The interworkstation coupling tethers 262 are secured between the d-rings 204 abutting each of the workstations 200. This configuration provides a flexible coupling between workstations 200.

Figure 14:
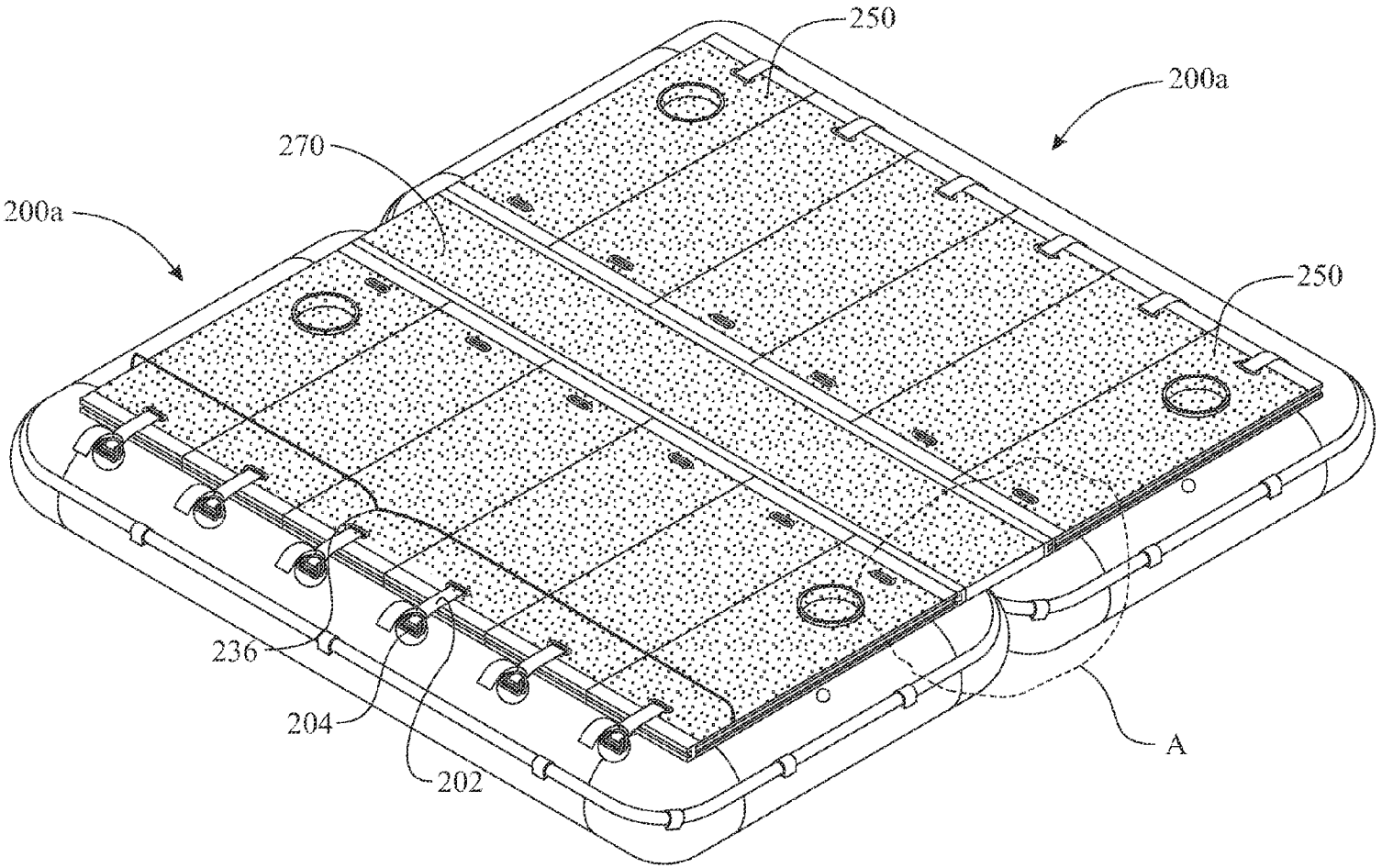
FIG. 14 shows a lateral inter-workstation coupling configuration.
Figure 15:
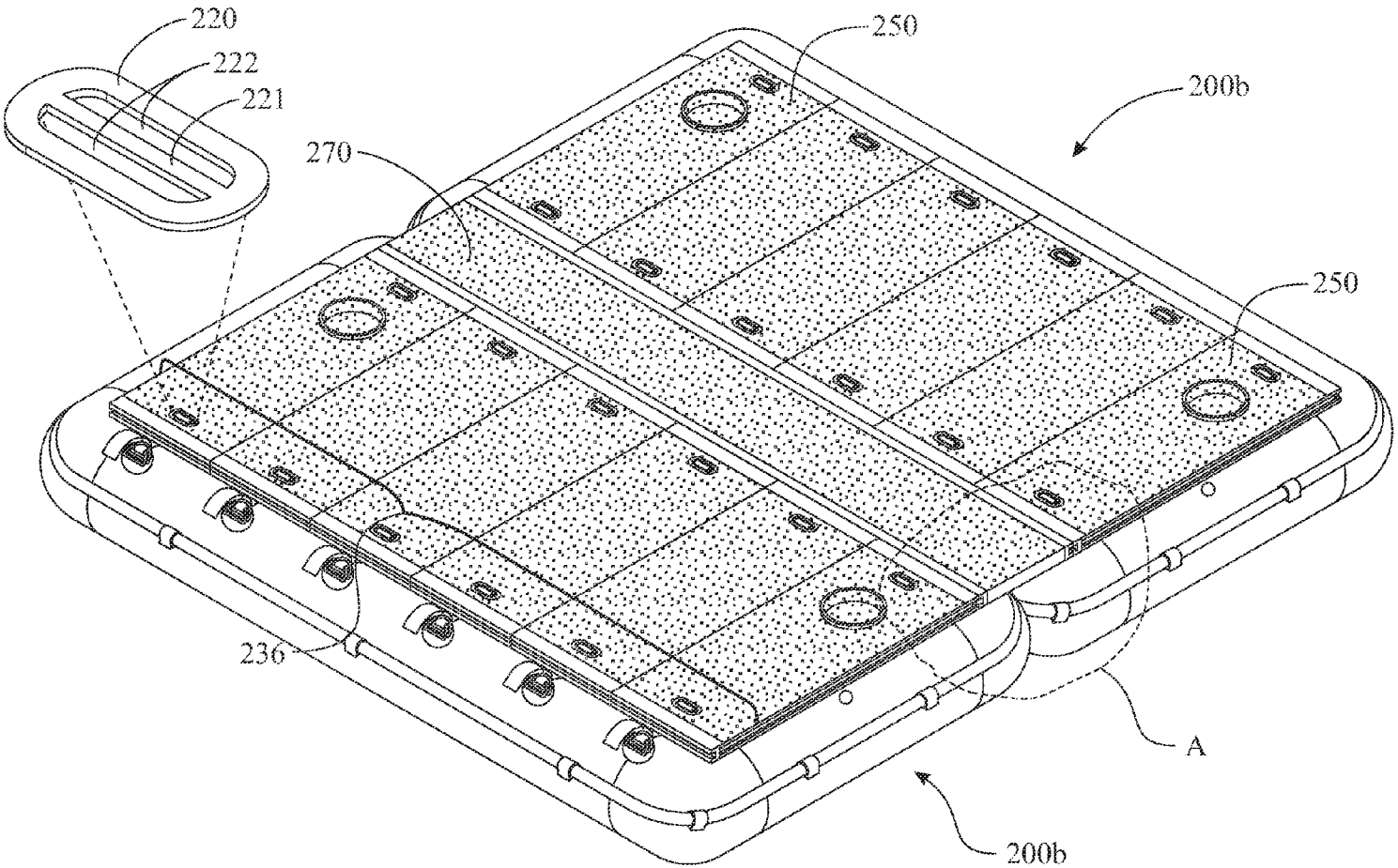
FIG. 15 shows a lateral inter-workstation coupling configuration, additionally incorporating an alternate deckboard securing design.
Figure 16:
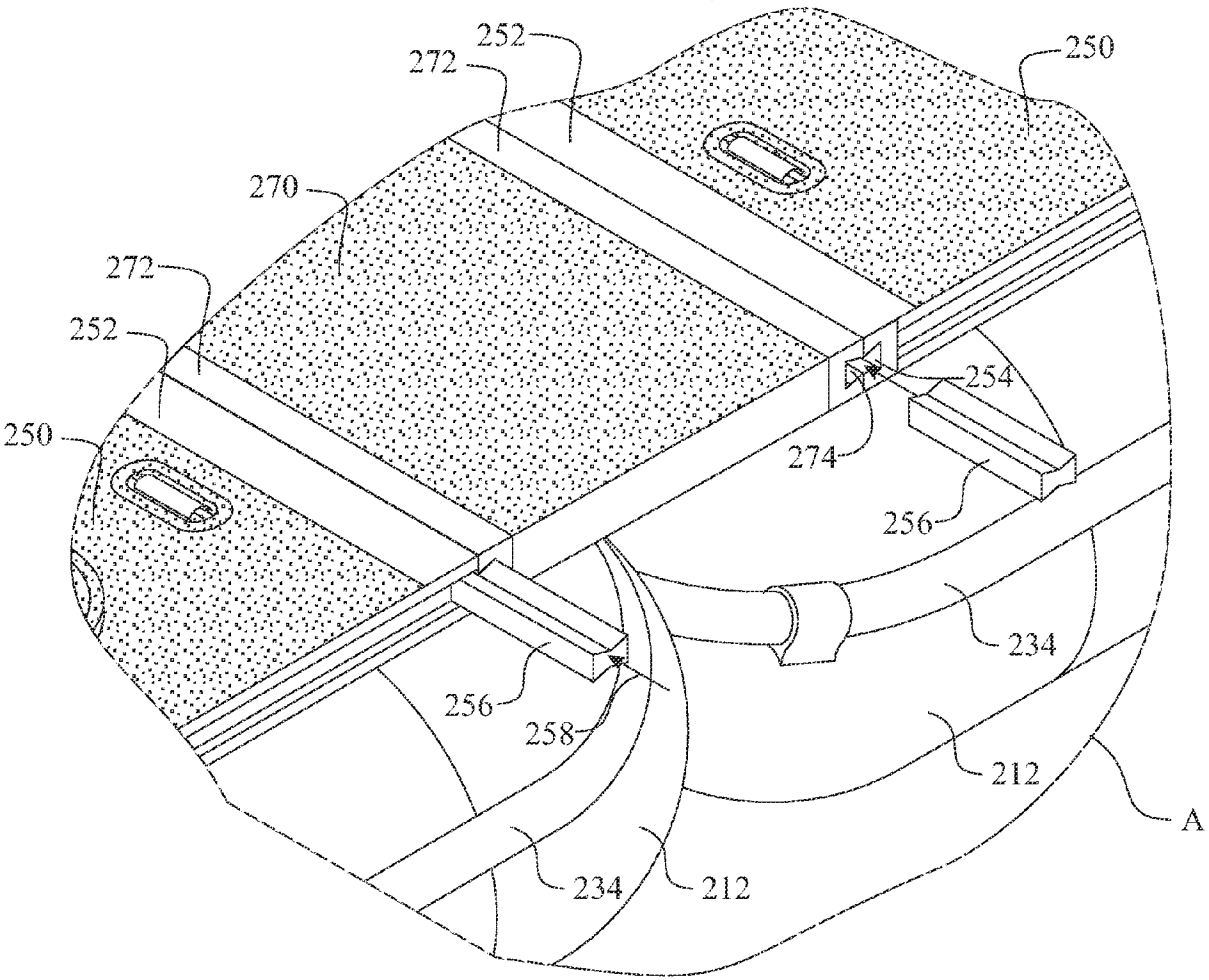
FIG. 16 shows a magnified view presenting details of a lateral inter-workstation coupling interface.
Figure 17:
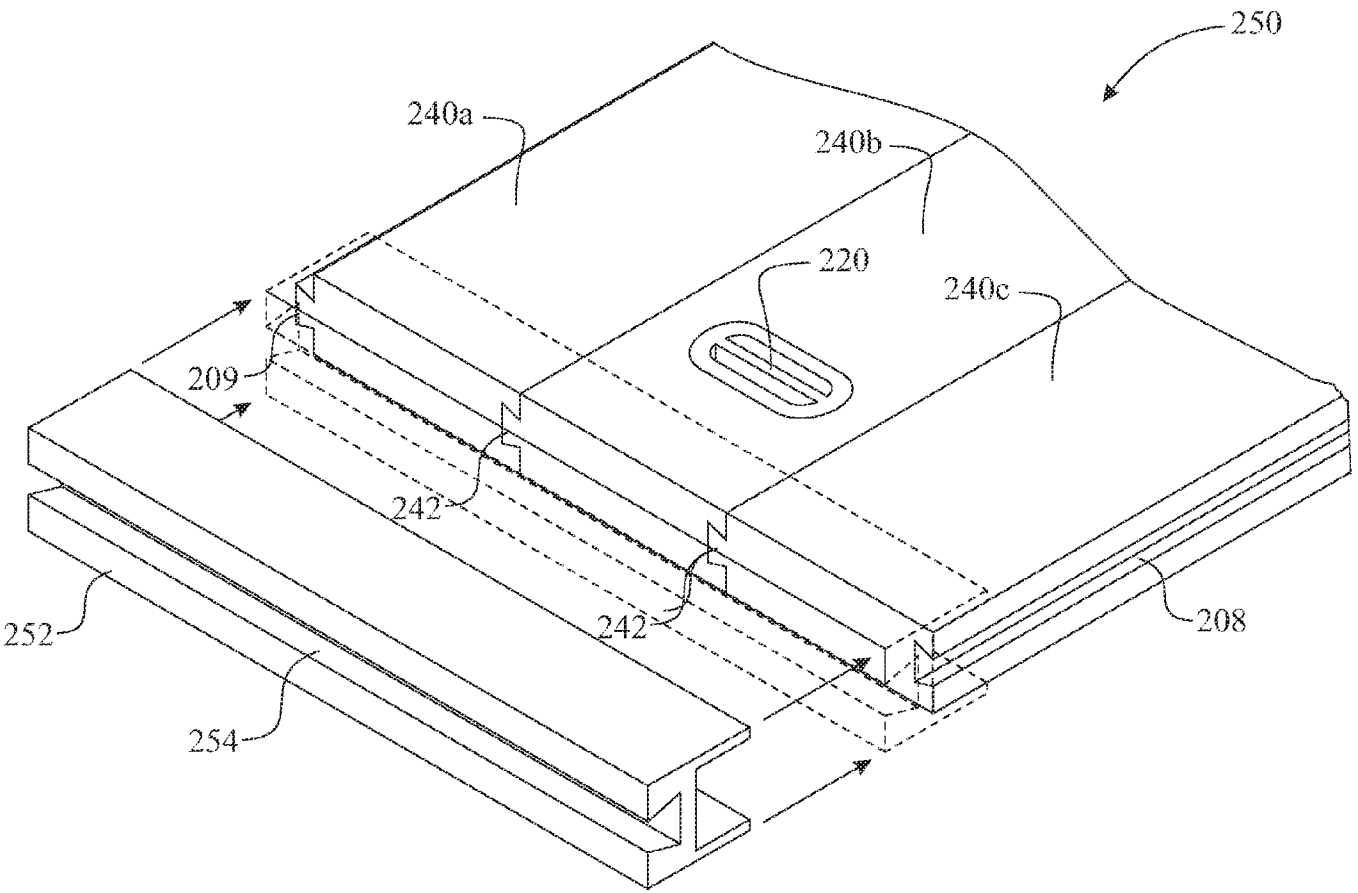
FIG. 17 shows an exemplary embodiment of an alternate deckboard assembly.

A third co-joining embodiment utilizes a longitudinal coupling deckplank 270 assembled between the elongated sides of the work platform 236 of two adjacent floatable workstations 200, as best illustrated in FIG. 14 with details of the interlocking means presented in exploded view A illustrated in FIG. 16. The assembly and features of the deckboards 250 is best shown in the detailed illustration of FIG. 17. Each deckboard 250 is fabricated by assembling a plurality of deckboard submember 240, preferably using the same interlocking configuration 208, 209 to form a deckboard subassembly interlocks 242. In the exemplary embodiment, three deckboards 240*a*, 240*b*, 240*c* are used. An endlocking endcap 252 is assembled to each shorter edge of the endlocking deckboards 250. The endlocking endcap 252 incorporates an endlocking slot 254 centered lengthwise about the side opposing the attaching portion; providing an end-to-end connection means for each endlocking deckboards 250.

A strap receptacle 220 and respective aperture are disposed within the deckboard submember 240*b* preferably centered proximate each shorter edge. The strap receptacle 220 is formed having a strap securing loop 221, flanked by two strap apertures 222. This design allows the deckboard securing straps 202 to be positioned through a first strap aperture 222, over the strap securing loop 221, and returning through a second strap aperture 222, thus exposing the endlocking slot 254 for interconnectivity.

The longitudinal coupling deckplank 270 would be assembled between the two workstations 200*a* via the insertion 258 of a interlocking insertion member 256 into each of endlocking slot 254 of the endlocking deckboards 250 and a longitudinal interlocking slot 274 integrated into a longitudinal member edging 272 of the longitudinal coupling deckplank 270. The longitudinal coupling deckplank 270 is preferably the same width as required to span the gap created between the two adjacent work platforms 236*a*. The longitudinal coupling deckplank 270 can be a single member or multiple subsections, accounting for variations in the number of endlocking deckboards 250 or overall length of the 236.

As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but defined in accordance with the foregoing claims appended hereto and their equivalents.

What is claimed is:

1. A floatable workstation comprising:

an inflatable tube having at least one air receiving chamber and a valve in fluid communication with said at least one chamber for inflating said at least one chamber with air;

a deck assembly removeably attached to said inflatable tube, the deck assembly comprising a plurality of detachably interlocking deckboards;

wherein said deck assembly is attached to said inflatable tube proximate an upper surface of said inflatable tube via an attaching interface; and an interlocking feature located along at least one shorter edge of each deckboard for interlocking the plurality of detachably interlocking deckboards.

2. The floatable workstation of claim 1, wherein said plurality of interlocking deckboards are interconnected via an interlocking feature that is assembled via any one of a longitudinal sliding motion and a vertical insertion motion.

3. The floatable workstation of claim 2, wherein the interlocking feature is a dovetail joint.

4. The floatable workstation of claim 1, said attaching interface having a plurality of straps, each strap being positioned through a strap receptacle provided on said deckboard.

5. The floatable workstation of claim 1, wherein at least one deckboard further comprising an indented receptacle for securely receiving at least one of tools and a bucket therein.

6. The floatable workstation of claim 1, wherein said inflatable tube comprises any shape, size and dimension, and is fabricated from at least one of hyperlon; PVC; and at least one of a plastic, synthetic, fabric, vinyl, rubber, foam rubber, fabric, mesh, and nylon material applied to at least one side.

7. The inflatable platform of claim 1, further including a tether system including tethers, one end of each tether including a means for fastening said one end of each tether to a corner fastening member, and another end of each tether being attached to at least one suction mechanism for securely attaching said inflatable platform alongside a vessel, each tether comprising any one of webbing straps, rope, cords, elastic tubes, straps, braids, wires, chains, bungee cords, nylon straps, rubber strips or strands, strings, belts, or bands.

8. An inflatable platform comprising:

a base having an inflatable tube having at least one air receiving chamber and a valve in fluid communication with said at least one chamber for inflating said at least one chamber with air;

a deck assembly removably attached to said inflatable tube so as to substantially cover said base, the deck assembly comprising a plurality of detachably interlocking deckboards;

wherein said deck assembly is attached to said inflatable tube proximate an upper surface of said inflatable tube via an attaching interface, the attaching interface comprising at least one strap and a plurality of strap securing members; and an interlocking feature located along at least one shorter edge of each deckboard.

9. The floatable workstation of claim 8, wherein the interlocking feature is a dovetail joint.

10. The floatable workstation of claim 8, said attaching interface having a plurality of straps, each strap being positioned through a strap receptacle provided on said deckboard.

11. The floatable workstation of claim 8, wherein said deckboards additionally comprise an interlocking feature located along at least one shorter edge of each deckboard.

12. The inflatable platform of claim 8, wherein said deckboard assembly further comprise a friction surface.

13. The floatable workstation of claim 8, wherein said plurality of interlocking deckboards are interconnected via an interlocking feature that is assembled via any one of a longitudinal sliding motion and a vertical insertion motion.

14. The floatable workstation of claim 13, wherein the interlocking feature is a dovetail joint.

15. The floatable workstation of claim 8, wherein at least one deckboard further comprising an indented receptacle for securely receiving at least one of tools and a bucket therein.

16. The floatable workstation of claim 8, wherein said inflatable tube comprises any shape, size and dimension, and is fabricated from at least one of hyperlon; PVC; and at least one of a plastic, synthetic, fabric, vinyl, rubber, foam rubber, fabric, mesh, and nylon material applied to at least one side.

17. The inflatable platform of claim 8, further including a tether system including tethers, one end of each tether including a means for fastening said one end of each tether to a corner fastening member, and another end of each tether being attached to at least one suction mechanism for securely attaching said inflatable platform alongside a vessel, each tether comprising any one of webbing straps, rope, cords, elastic tubes, straps, braids, wires, chains, bungee cords, nylon straps, rubber strips or strands, strings, belts, or bands.

18. A floatable workstation comprising:

an inflatable tube having at least one air receiving chamber and a valve in fluid communication with said at least one chamber for inflating said at least one chamber with air;

a deck assembly removeably attached to said inflatable tube, the deck assembly comprising a plurality of detachably interlocking deckboards;

wherein said deck assembly is attached to said inflatable tube proximate an upper surface of said inflatable tube via an attaching interface;

at least one deckboard additionally comprising at least one of:

an indented receptacle for securely receiving at least one of tools and a bucket therein, and an interlocking feature located along at least one shorter edge;

at least one of a bumper and a rope disposed completely around the outside perimeter of said inflatable tube.

19. The floatable workstation of claim 18, wherein said inflatable tube comprises any shape, size and dimension, and is fabricated from at least one of hyperlon; PVC; and at least one of a plastic, synthetic, fabric, vinyl, rubber, foam rubber, fabric, mesh, and nylon material applied to at least one side.

20. The inflatable platform of claim 18, further including a tether system including tethers, one end of each tether including a means for fastening said one end of each tether to a corner fastening member, and another end of each tether being attached to at least one suction mechanism for securely attaching said inflatable platform alongside a vessel, each tether comprising any one of webbing straps, rope, cords, elastic tubes, straps, braids, wires, chains, bungee cords, nylon straps, rubber strips or strands, strings, belts, or bands.

21. The floatable workstation of claim 18, the at least one deckboard comprising an indented receptacle for securely receiving at least one of tools and a bucket therein.

22. The floatable workstation of claim 18, said deckboards additionally comprise an interlocking feature located along at least one shorter edge of each deckboard.

* * * * *